US006315063B1

(12) United States Patent
Martini

(10) Patent No.: US 6,315,063 B1
(45) Date of Patent: Nov. 13, 2001

(54) RECIPROCATING ROTARY DRILLING MOTOR

(76) Inventor: Leo A. Martini, 7602 Hwy. 859 P.O. Box 795, Edgewood, TX (US) 75117

( * ) Notice: Subject to any disclaimer, the term of this patent is extended or adjusted under 35 U.S.C. 154(b) by 0 days.

(21) Appl. No.: 09/432,870

(22) Filed: Nov. 2, 1999

(51) Int. Cl.[7] ..... E21B 1/12
(52) U.S. Cl. ..... 175/57; 175/92; 173/73
(58) Field of Search ..... 175/57, 92, 97, 175/106; 173/73, 59, 91, 93.5, 93.6, 100, 104

(56) References Cited

U.S. PATENT DOCUMENTS 3,602,317 * 8/1971 Scroggins ..... 173/73
3,612,191 * 10/1971 Martini ..... 173/73
3,735,820 * 5/1973 Currington ..... 173/78
3,899,033 * 8/1975 VanHuisen ..... 175/97
3,946,819 3/1976 Hipp .
4,846,288 * 7/1989 Hunt ..... 173/105

* cited by examiner

*Primary Examiner*—Frank Tsay
(74) *Attorney, Agent, or Firm*—Dennis T. Griggs

(57) ABSTRACT

An improved downhole fluid pressure powered reciprocating rotary drilling motor includes an automatic fluid valve means and a fluid controller that in combination provide a fluid driven periodic forcing function to excite a drill bit both axially and rotationally for enhanced drill bit penetration in oil well work-over and oil well open hole earth borings on both rotating and non-rotating drill strings.

16 Claims, 3 Drawing Sheets

RECIPROCATING ROTARY DRILLING MOTOR

TECHNICAL FIELD

The present invention relates to an improved downhole reciprocating rotary fluid powered drilling motor for use on rotating and non-rotating drill strings in oil well work-over servicing and open hole oil well earth boring to improve drilling effectiveness and increase drill bit penetration rates.

BACKGROUND OF THE INVENTION

This application is for an invention previously described in my Disclosure Document No. 449,617 entitled "RECIPROCATING DRILLING MOTOR" filed Jan. 11, 1999 in the United States Patent and Trademark Office under the Disclosure Document Program (MPEP 1706).

Because of various oil well conditions, variable drilling applications, diverse drilling mediums, various drilling rig configurations, and rig operator preferences considerable research, development, time, effort and cost have been applied to perfect a reciprocating rotary drilling motor of the nature described herein. Certain levels of success have been achieved over the ensuing years and progress is continuing to this day as all factors concerned, tried, tested and incorporated contributed to the present invention.

SUMMARY OF THE INVENTION

Because of the aforementioned variables a broad range of tool operations is needed to accommodate most well service and open hole drilling conditions, and great improvements in drill penetration rates have been achieved in all drillable media.

The present invention provides for faster drilling in oilfield applications but can also be used in drilling water wells, geophysical bore holes, environmental test holes, quarry blast holes, construction pier holes and the like. In order to increase the drill bit penetration rate, this invention provides a rotary automatic pressure fluid driven periodic fast cycling forcing function motor wherein the drill bit is alternately thrust forward by pressure fluid impulse and then hammered forward by percussive impact with sustained high frequency energy delivery to the medium being drilled.

DETAILED DESCRIPTION

Figure 1:
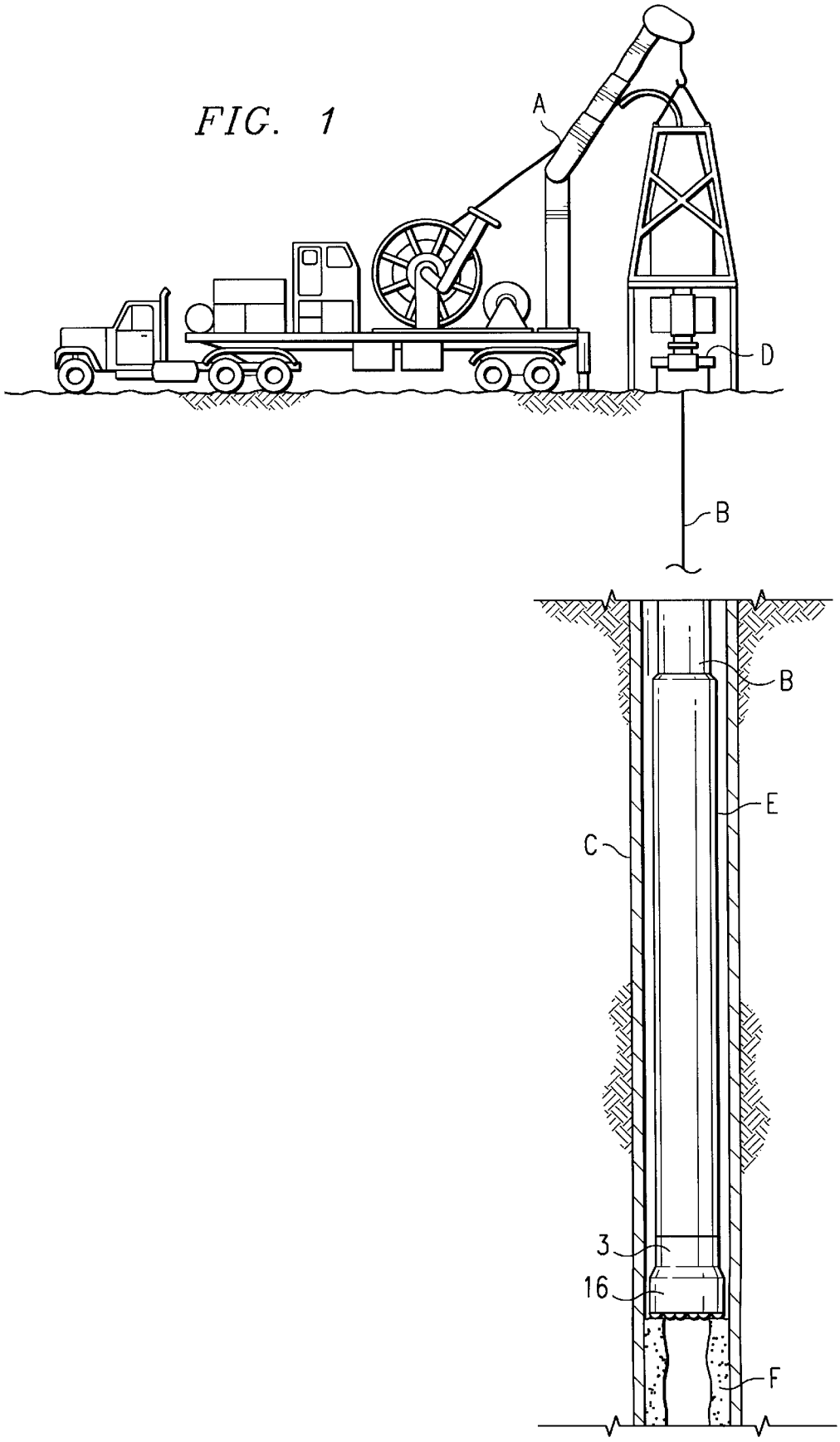
FIG. 1 is an illustration of a coiled tubing oil well work-over service rig A with a non-rotating drill string B in an old production well with well head components D showing the application of the fluid powered reciprocating rotary drilling motor E drilling out mineral deposits that have accumulated in the production tubing C.
Figure 2:
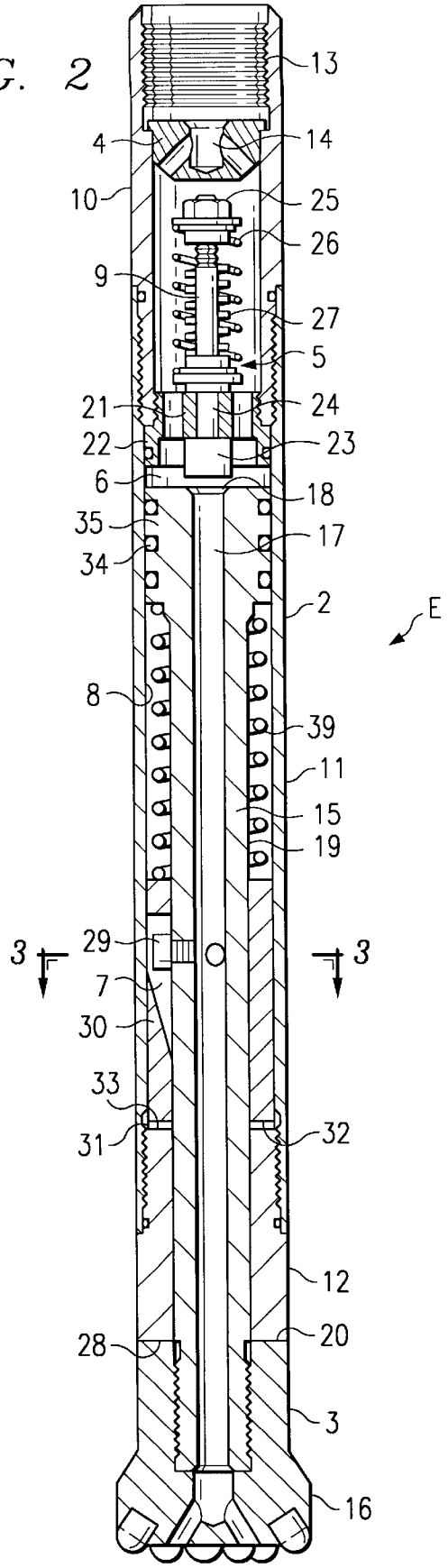
FIG. 2 is an elevational view in central section of the drilling motor with means for attachment to the distal end of a coiled tubing drill string on its upper end and a drill bit on its lower end.
Figure 3:
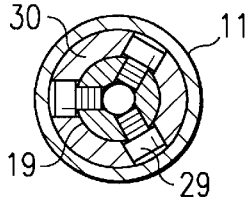
FIG. 3 is a cross-sectional view taken at section line 3—3 of FIG. 2 showing a motor cam and cam follower reciprocal mandrel rotational means.
Figure 4:
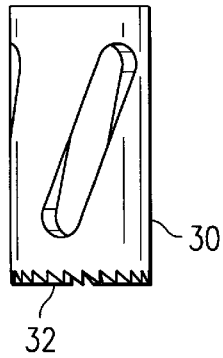
FIG. 4 is a side elevational view of a tubular cam with helical slots for the followers and a single direction rotational clutch face on its lower end.
Figure 5:
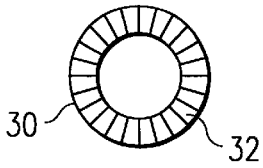
FIG. 5 is a end view of the lower end of the cam showing the circled radial teeth of the clutch face.

The preferred embodiment of the reciprocating drilling motor E in FIG. 2 consists of a housing 2, mandrel-bit 3, fluid control means 4, automatic valve means 5, variable pressure and volume fluid chamber 6, and mandrel-bit rotation means 7. Housing 2 is made up of top sub 10, barrel 11 and bearing sub 12 and all are sealed and threadably connected. Housing top sub 10 has threaded connection means 13 to the non-rotatable coiled tubing drill string and the pressure fitted supply therein. Housing 2 further has internal fluid containment walls to conduct fluid from the fluid control means 4 past and outside the automatic valve means 5 and forms part of the variable chamber 6 as well as mounting for mandrel-bit 3. On its lower end is an impact receiving surface 28 that coacts with the bit 16 of the mandrel-bit 3 for transferring impact blows thereto. Mandrel-bit 3 is made up of mandrel 15 and threadably connected bit 16 and has a fluid flow passageway 17 through the mandrel and bit with a valve seat 18 around the upper end.

The mandrel 15 has an enlarged upper end 35 in close fitting sealed relation with the inside bore 8 of barrel 11, a reduced diameter shank 19 in close fitting relation with the inside diameter of bearing sub 12 and is adapted for axial limited movement with the housing 2. The bit 16 may be of any style and cutting structure on its lower end and has an impact receiving surface 20 on its upper end. Seals 34 are provided on the mandrel upper enlarged end to prevent fluid passage between the upper end 35 of the mandrel 15 and barrel 11 of housing 2.

The fluid control means 4 is an orifice type fluid metering flow restrictor having an inside passageway 14 therethrough and is fixed inside top sub 10. This control means 4 determines how fast the variable chamber 6 expands and contracts and thereby determines the motor cycling frequency. Fluid control means 4 may also have a fluid diffuser to prevent fluid steam from impacting on the automatic valving means 5 and altering operation of it.

The automatic valving means 5 consists of valve support means 21 having a fixed mounting inside top sub 10 with a fluid flow passageway 24 through it, valve 22 made up of valve head 23 and valve stem 9 which has valve stroke adjustment means 25 on its upper end, valve shift spring 26 that is nested on both ends and allows the valve 22 to easily shift downward but will position the valve upward and valve lift-off spring 27 around valve stem 9 that accelerates the valve upward very fast when the valve head 23 separates from the valve seat 18.

At the start of the valve means 5 operational cycle, the valve head 23 is spaced from valve seat 18 of the mandrel-bit 3 and mandrel 15 so that a pressure differential force exits across the valve head 23 and valve seat 18 when the pressure fluid supply through the flow control means 4 reaches a certain volume. The pressure differential force causes valve head 23 to rapidly shift to seat 18, thereby stopping fluid flow through passageway 17 and causing the pressure and volume to build up in the variable pressure fluid chamber 6. The pressure and volume expand with equal and opposite force against the housing 2 upwardly and the upper end surface of mandrel 15 forcing it downwardly overcoming the down force of the drill string or the forward resistance of the bit 16 or a combination of each resistance depending on which has the least resistance.

The bit 16 then may be driven forward or the housing may be raised by the stroke distance of the valve 22. During the valve 22 stroke, spring 26 is compressed and spring 27 is compressed each storing energy to perform a certain function when the stroke limit is reached and valve liftoff occurs. As the mandrel 15 moves down relative to the housing 2 and the valve 22 stroke limit is reached, further movement causes the valve head 23 to leave valve seat 18 relieving pressure in chamber 6. Valve liftoff spring 27 then rapidly accelerates the valve 22 upwardly since there is no longer a pressure differential across valve head 23 and valve seat 18 and valve shift spring 26 repositions the valve 22 to its original cycle start position.

At this time in the motor operational cycle with the pressure forcing function of chamber 6 dissipated, the down force of the drill string and resistance of the bit become the dominant motor forces, chamber 6 reduces to its original size and the mandrel-bit 3 and the housing collide at the impact receiving surface 20 of the mandrel-bit 3 and impact receiving surface 28 of the housing 2. The valve head 23 is now originally spaced with valve seat 18 and a new motor cycle is ready to begin.

Motor cycling frequency can occur very many times a minute providing alternate bit force pressure thrusts with stored energy percussive blows to bit 16. The motor described herein can be effective in removing tubing mineral deposits without rotary rotational producing means 7 if fitted with a suitable full circle cutting bit structure. For drilling solid well material such as cement or bridge plugs, rotary bit action combined with dual vertical thrust and percussive forces, the motor effectivity is greatly enhanced.

The mandrel bit rotation means 7 of FIG. 2 consists of a cam follower 29 fixed with the shank 19 of mandrel 15, a slotted helical cam 30 in working engagement with the cam follower 29, a one-way directional clutch 31 half of which is clutch face 32 and is part of the cam and half of which is clutch face 33 and is part of bearing sub 12 of housing 2 and a spring 39 for biasing the cam downward and keeping the clutch faces in engagement. FIGS. 2, 3, 4 and 5 show the above relationships.

In operation of the mandrel-bit 3 and rotational means 7, the mandrel strokes up and down as before described but now also rotates the cam 30 in one direction but cannot rotate the cam 30 in the opposite direction because of the one-way directional clutch 31. The operation of the mechanism is such that the cam on one directional stroke in combination with the cam follower and clutch will rotate the mandrel bit some angled amount and on the opposite directional stroke will reset the clutch 31 to another position and fast stroke repetition will provide intermittent stepped periodic mandrel-bit 3 rotation relative to the housing 2.

Figure 6:
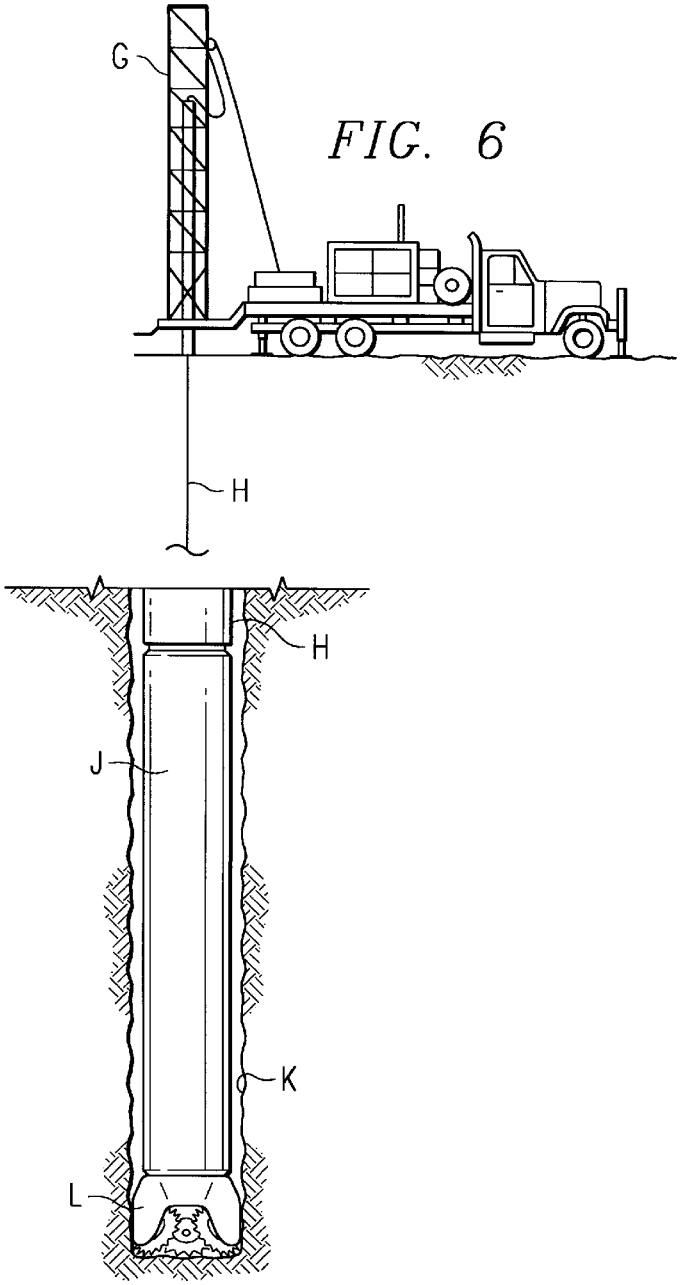
FIG. 6 is an illustration of a land open hole rotary drilling rig with rotating drill string and application of the drilling motor having a splined extension joint for bit rotation.
Figure 7:
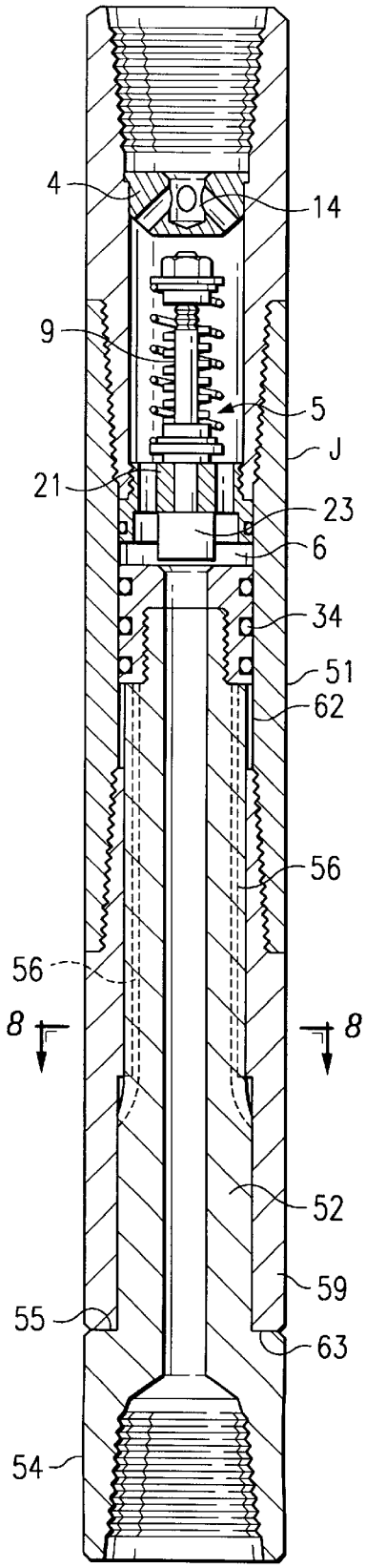
FIG. 7 is an elevational view through the central section of the drilling motor of FIG. 6 with means for attachment to a rotating drill string on its upper end, a splined extension joint near is lower end for transferring rotary torque while allowing motor mandrel extension and retraction and means for attaching a bit on its lower end; and, FIG. 8 is a cross-sectional view taken at section line 8—8 of FIG. 7 further showing the splined torque transmitting slip joint.
Figure 8:
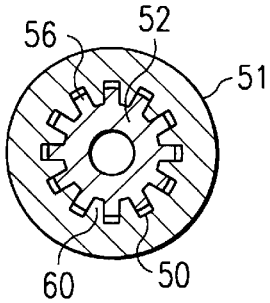

FIGS. 6, 7 and 8 show the pressure fluid powered rotary drilling motor used with conventional type open hole drilling rig G having the usual surface rotated drill string H. Since the drill string is rotated there is no requirement for bit rotational means within the drilling motor so a variation of the motor is specified herein with a mandrel-bit splined extension means 50 for transferring the drill string H provided torque from the motor J housing 51 to the motor mandrel 52 and bit L. In the application the mechanical structure of the motor must be somewhat heavier since the motor down force is provided by weighted drill collars and the mandrel 52 has been modified to take the percussion blow involved.

Since use with a more conventional bit L is desirable but most of the principles of the motor operation involved are the same as before described such as the fluid control means 4, the automatic valving means 5, the variable fluid chamber 6, and the reciprocating mandrel-bit 54 are now made up of mandrel 52 and bit L and have the impact receiving surface 55 on an enlarged portion upward facing surface of the mandrel 52 and the impact receiving surface 63 on the downward facing surface of the spline sub 59. Internal splines 56 of motor housing 51 as a portion of bearing and spline sub 59 are mated with external longitudinal splines 60 on the mandrel shank 52 and adapted for sliding coaction while transferring rotary motion to the mandrel 52 and bit L.

The chamber 6 (FIG. 7) formed by components of housing 51 and the motor mandrel 52 may be sealed and contain a lubricant for increased service life and the lubricant can pass through splined extension means 50 with very little motion damping. Also better bearings may be added between the bearing sub 59 and the mandrel 52 without deviating from the spirit of the invention. In FIGS. 2, 3, 4 and 5 wherein the mandrel-bit 3 rotational means 7 is shown and described, a different configured cam may be used and the whole mechanism may be sealed and lubricated.

The foregoing specification is exemplary of certain preferred embodiments and explains how to make and use the invention. The appended claims are intended to cover the embodiments disclosed as well as improvements which may be added within the scope of the invention.

What is claimed is:

1. An improved fluid pressure powered reciprocating drilling motor comprising:

a housing for applying a down force;

a mandrel-bit mounted for sealed extension with the housing;

means for supplying a pressure fluid to the housing;

an automatic fluid valve means having an opening and closing cycle frequency;

a pressure fluid responsive mandrel for providing resistance to the housing down force;

a variable volume fluid chamber defined in part by the housing, the mandrel-bit and the automatic fluid valve means for varying fluid pressure and volume in the chamber;

a fluid control means to limit and meter pressure and volume to the automatic fluid valve means and thereby determine valve means cycle frequency and impulsive pressure forces in the chamber; and, impact receiving surfaces on the housing and the mandrel-bit, wherein periodic pressure fluid force in the chamber becomes greater than the housing down force and/or greater than the mandrel-bit resistance and thereby alternately forces the impact receiving surfaces of the housing and the impact receiving surfaces of the mandrel-bit apart some distance and then allows them to come together in collision at the valve means cycle frequency thereby producing percussive blows and motor reciprocating vibratory action for improved bit drilling performance.

2. An improved fluid pressure powered reciprocating drilling motor comprising:

a housing including means for receiving a pressure fluid and means for receiving a down force;

an orifice type fluid control means in the housing to limit fluid flow;

an automatic fluid valve means having opening and closing cycle period determined by the fluid control means;

a variable volume fluid chamber defined in part by the housing and the automatic valve means;

a mandrel-bit mounted for sealed extension with the housing having a downward facing bit face that provides resistance to the housing down force, an upward facing surface having a valve seat and flow passageway defining a portion of the variable volume fluid chamber wherein the housing and mandrel-bit are forced apart and allowed to come together responsive to forces generated in the variable volume fluid chamber; and, impact receiving surfaces on the housing and mandrel-bit that are adapted to part and collide with percussive impacts during the opening and closing cycle period.

3. An improved fluid pressure powered rotary reciprocating drilling motor as set forth in claim 2 wherein the motor also includes bit rotation producing means.

4. An improved fluid pressure powered rotary reciprocating drilling motor as set forth in claim 2 wherein the motor has torque transferring means coupled between the housing and the mandrel of the mandrel-bit.

5. An improved fluid pressure powered rotary reciprocating drilling motor as set forth in claim 2 wherein the housing provides:

means for connection to a tubular drill string on its upper end and the pressure fluid supply therein;

a down force transfer means coupled to the drill string to effectively move and accelerate the housing forward;

bearing and seal surfaces in its lower portion to receive the mandrel bit;

means for affixing the flow control means in the upper portion of the housing; and support means for the valve means.

6. An improved fluid pressure powered rotary reciprocating drilling motor as set forth in claim 2 wherein the mandrel-bit has a mandrel that includes an enlarged generally cylindrical upper portion in close fitting sealed arrangement with the inside wall of the housing, an upward facing surface forming part of the variable chamber, a central fluid passageway larger than the orifice of the fluid control means extending from the facing surface through to the bit, a valve seat around the central passage on the facing surface for coaction with the valve of the valve means, a reduced diameter shank below the cylindrical portion, a part of which forms a bearing with the housing and is adapted for longitudinal sliding displacement with the housing, and wherein the mandrel-bit has a bit of suitable configuration for the application attached to the mandrel, and a fluid passageway through the bit.

7. An improved fluid pressure powered rotary reciprocating drilling motor as set forth in claim 2 wherein the flow control means is an orifice type restriction that meters pressure fluid and fluid volume into the variable chamber thereby determining how fast the chamber expands and contracts and with a predetermined valve means valve stroke will determine the opening and closing cycle period in any given drilling application.

8. An improved fluid pressure powered rotary reciprocating drilling motor as set forth in claim 2 wherein the valve means comprises:

a valve made up of a valve head and valve stem which has valve stroke length adjustment parts and limited valve stroke, a valve means support member which guides the valve during its stroke and provides for fluid passage around the outside of the valve, a first larger diameter weaker spring that biases the valve upward but allows the valve to seat with the mandrel bit easily and also to position the valve upwardly after the valve is unseated in response to valve seat downward movement, a second nested seated stronger smaller diameter spring that when compressed as the valve moves down with the valve seat quickly accelerates the valve upward from the valve seat when the valve stroke limit is reached and valve liftoff occurs, the arrangement being such that an automatic periodic valving means is provided in cooperation with the flow control means, the variable fluid chamber and the mandrel-bit for impulsively forcing the mandrel-bit or forcing the housing or both the mandrel-bit and the housing depending on the opposing resisting forces of each.

9. The improved fluid pressure powered reciprocating motor as set forth in claim 2 and wherein the motor also has bit rotary rotational means comprising:

a cam follower means coupled to the mandrel-bit for rotating the mandrel-bit;

cam means for rotating the cam follower during the stroke movement of the mandrel-bit; and clutch means that allows one directional rotation of the cam means relative to the housing.

10. An improved fluid pressure powered reciprocating motor as set forth in claim 9 wherein the clutch means includes:

clutch faces having mating teeth that allow one clutch face to rotate relative to the other clutch face in a single direction; and spring means to maintain the clutch faces in resilient force contact at all times.

11. An improved fluid pressure powered reciprocating motor as set forth in claim 2 comprising:

said housing including an upward facing one way directional rotation toothed clutch face;

a tubular slotted helical cam surrounding the mandrel-bit with a mated toothed downward facing clutch face on its lower end for stepped coaction with the clutch face of the housing allowing one way rotation of the cam;

a cam follower coupled to the mandrel and in engagement with the cam so that when the mandrel-bit strokes one way relative to the housing it will also rotate one radial angle step and when the mandrel-bit strokes in the other direction the cam will reset incrementally the clutch faces to a new position and thereby on each cycle of the motor the mandrel-bit rotates one step repetitively multiple times per minute for enhanced drill bit penetration when used with non-rotating drill strings.

12. An improved fluid pressure powered reciprocating motor as set forth in claim 11 wherein the motor includes mandrel-bit rotational means and a spring means within the housing providing a resilient force to keep the cam and the housing in engagement during periodic stepped rotational movement of the cam and the mandrel-bit.

13. An improved fluid pressure powered reciprocating motor as set forth in claim 2, said housing including internal splines near its lower end that mate with external splines carried on the mandrel-bit so that when the housing is rotated, the mandrel bit is also rotated thereby providing the bit with both rotary and impact action for enhanced drilling when used with surface rotated drill strings.

14. An improved fluid pressure powered reciprocating motor as set forth in claim 2 wherein the pressure fluid supply and the down force applied on the motor provides energy application forces that alternately thrusts the bit forward and hammers the bit forward at relatively high frequency.

15. An improved fluid pressure powered reciprocating motor as set forth in claim 2 wherein the variable chamber expansion causes momentary mandrel-bit extension relative to the housing and thereby thrusts the bit forward against resistance.

16. An improved fluid pressure powered reciprocating motor as set forth in claim 2 wherein the housing down force causes the housing to accelerate downward and impact against the mandrel at variable chamber contraction thereby providing a forward percussive blow to the bit.

* * * * *